US009739513B2

(12) United States Patent
Ochiai et al.

(10) Patent No.: US 9,739,513 B2
(45) Date of Patent: Aug. 22, 2017

(54) AIR CONDITIONING APPARATUS

(75) Inventors: Yasutaka Ochiai, Tokyo (JP); Fumitake Umezaki, Tokyo (JP); Kosuke Tanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 808 days.

(21) Appl. No.: 13/700,162

(22) PCT Filed: Jun. 23, 2010

(86) PCT No.: PCT/JP2010/004168

§ 371 (c)(1),
(2), (4) Date: Nov. 27, 2012

(87) PCT Pub. No.: WO2011/161720

PCT Pub. Date: Dec. 29, 2011

(65) Prior Publication Data

US 2013/0067942 A1 Mar. 21, 2013

(51) Int. Cl.
*F25B 49/02* (2006.01)
*F24F 11/053* (2006.01)
(Continued)

(52) U.S. Cl.
CPC ..... *F25B 49/02* (2013.01); *F25B 49/005* (2013.01); *F25B 13/00* (2013.01); *F25B 2600/21* (2013.01)

(58) Field of Classification Search
CPC ..... F25B 2345/001; F25B 2345/002; F25B 2345/003; F25B 2345/004; F25B 2500/22;
(Continued)

(56) References Cited

U.S. PATENT DOCUMENTS 5,214,918 A * 6/1993 Oguni ..... F25B 13/00 62/126
8,109,105 B2 * 2/2012 Unezaki ..... F25B 9/008 62/129
(Continued)

FOREIGN PATENT DOCUMENTS

JP 11-182990 A 7/1999
JP 2005-257219 A 9/2005
(Continued)

OTHER PUBLICATIONS

Office Action mailed Jul. 8, 2014 issued in corresponding JP patent application No. 2012-521166 (and English translation).
(Continued)

*Primary Examiner* — Frantz Jules
*Assistant Examiner* — Meraj A Shaikh
(74) *Attorney, Agent, or Firm* — Posz Law Group, PLC

(57) ABSTRACT

An air-conditioning apparatus detects refrigerant leak with high-accuracy even in a state in which an excessive liquid refrigerant is stored in an accumulator. The air-conditioning apparatus determines that leakage of refrigerant has occurred from a refrigerant circuit in an operating state in which an excessive liquid refrigerant is stored in an accumulator, after a part of the excessive liquid refrigerant stored in the accumulator is moved and stored into a condenser, with the excessive liquid refrigerant remaining in the accumulator as a reference amount, when the excessive liquid refrigerant is less than the reference amount.

14 Claims, 7 Drawing Sheets

(51) Int. Cl.
*F24F 11/047* (2006.01)
*F25B 49/00* (2006.01)
*F25B 13/00* (2006.01)

(58) Field of Classification Search
CPC ..... F25B 2500/221; F25B 2500/222; F25B 2500/23; F25B 2500/24; F25B 2500/28; F25B 49/02; F25B 49/005; F25B 2700/00; F25B 49/21; F25B 49/2102; F25B 49/2103; F25B 49/2109; F25B 49/21163; F24F 11/00; F24F 11/04; F24F 11/047; F24F 11/053; F24F 11/06
USPC ..... 62/125–126, 129, 149, 228.1, 498
See application file for complete search history.

(56) References Cited

U.S. PATENT DOCUMENTS

2008/0209926 A1* 9/2008 Matsuoka ..... F25B 13/00 62/129
2009/0013700 A1* 1/2009 Unezaki ..... F25B 9/008 62/77
2009/0095000 A1 4/2009 Yoshimi et al.
2009/0126375 A1* 5/2009 Toyoshima ..... F25B 45/00 62/77
2010/0107665 A1* 5/2010 Kawano ..... F25B 13/00 62/149
2011/0000240 A1* 1/2011 Yamada ..... F25B 49/005 62/208

FOREIGN PATENT DOCUMENTS

JP 2005257219 A * 9/2005
JP 2005-351618 A 12/2005
JP 2007-147230 A 6/2007
JP 2008-185229 A 8/2008
JP 2008-249234 A 10/2008
WO 2006/090451 A1 8/2006
WO 2007/049372 A1 5/2007
WO 2007/125951 A1 11/2007
WO WO 2009107615 A1 * 9/2009 ..... F25B 49/005

OTHER PUBLICATIONS

International Search Report of the International Searching Authority mailed Sep. 14, 2010 for the corresponding international application No. PCT/JP2010/004168 (with English translation).
Office Action mailed Nov. 26, 2013 issued in corresponding JP patent application No. 2012-521166 (and English translation).
Office Action mailed Mar. 31, 2015 in the corresponding JP application No. 2012-521166 (and English translation).

* cited by examiner

AIR CONDITIONING APPARATUS

CROSS REFERENCE TO RELATED APPLICATION

This application is a U.S. national stage application of PCT/JP2011/004168 filed on Jun. 23, 2010.

TECHNICAL FIELD

The present invention relates to an air-conditioning apparatus having an accumulator (a liquid reservoir), and particularly relates to an air-conditioning apparatus with refrigerant leak detection technique by which leakage of a refrigerant charged in a refrigerant circuit can be detected in early stages.

BACKGROUND

Conventionally, when a refrigerant leak occurs in an air-conditioning apparatus having an accumulator, and when there is an excessive liquid refrigerant in the accumulator, a liquid level of the excessive liquid refrigerant merely lowers and temperature and pressure of a refrigeration cycle do not change. For this reason, even when leakage of the refrigerant occurs in the air-conditioning apparatus having the accumulator, it cannot be detected.

Accordingly, a variety of air-conditioning apparatuses which are configured so as to detect shortage of a refrigerant has been proposed. As one of these apparatuses, an air-conditioning apparatus is disclosed in which a sight glass is provided in an accumulator and a shortage of a refrigerant is detected by a method in which operating conditions coincide with reference conditions by performing a special operation (for example, refer to Patent Literature 1).

Further, an air-conditioning apparatus is disclosed which has an accumulator provided with a liquid level detection circuit such that a shortage of a refrigerant is detected while the state of the circuit is being measured (for example, refer to Patent Literature 2). Moreover, an air-conditioning apparatus is disclosed in which a special operation is performed and a measurement value concerning an amount of a liquid phase portion of a refrigerant in a high pressure side heat exchanger (a value of liquid phase temperature efficiency $\epsilon L$ (SC/dTc) calculated from temperature information), and a theoretical value (a value of a liquid phase temperature efficiency $\epsilon L$ (1-EXP(-NTUR) obtained from the number of transfer units NTUR on a refrigerant side) are calculated and compared to each other, whereby precise diagnosis of normality or abnormality is conducted (for example, refer to Patent Literature 3).

In addition, an air-conditioning apparatus is disclosed in which by performing a special operation of bringing the interior of an accumulator into a gas state, a refrigerant filled state is determined on the basis of a result of comparison between a predetermined value and a value obtained by calculation of a condenser liquid phase area ratio which is a value concerning an amount of refrigerant in a liquid phase portion in a high pressure side heat exchanger (for example, refer to Patent Literature 4).

CITATION LIST

Patent Literatures

Patent Literature 1: Japanese Patent Application Laid-Open (JP-A) No. 11-182990(Page 5, FIG. 2 and the like)

Patent Literature 2: JP-A No. 2007-147230 (Page 12, FIG. 5 and the like)

Patent Literature 3: WO 2006/090451 (Pages 9 and 10, FIG. 2 and the like)

Patent Literature 4: WO 2007/049372 (Page 10, FIG. 2 and the like)

SUMMARY

Technical Problem

However, such air-conditioning apparatuses as described in the patent literatures above each have problems that the structure of the apparatus becomes complex because a sight glass, which detects the presence or absence of the excessive liquid refrigerant in an accumulator, and the liquid level detection circuit are provided. Further, production cost thereof increases. Moreover, in the air-conditioning apparatuses as described in the patent literatures above, a problem also exists that since the influence on the indoor side while a special operation is performed is not considered, the performance of an indoor unit decreased and a room temperature is thereby influenced.

The present invention is addressed in view of these points, and an object of the invention is to provide an air-conditioning apparatus in which even when the excessive liquid refrigerant is stored in an accumulator, leakage of a refrigerant can be detected with a high degree of accuracy.

Solution to Problem

An air-conditioning apparatus according to the present invention includes an outdoor unit equipped with a compressor, a heat exchanger, and a liquid reservoir; an indoor unit equipped with an expansion valve and a heat exchanger, the compressor, the heat exchanger of the outdoor unit, the liquid reservoir, the expansion valve, and the heat exchangers of the indoor units being connected by refrigerant extension pipes to constitute a refrigerant circuit; and a control unit determining that a refrigerant has leaked from the refrigerant circuit when an excessive liquid refrigerant in the liquid reservoir is less than a reference amount, the reference amount being a rest of the excessive liquid refrigerant in the liquid reservoir after a part of the excessive liquid refrigerant stored in the liquid reservoir is moved into and stored in the heat exchanger that has been stopped and that functions as a condenser.

In the air-conditioning apparatus according to the present invention, the excessive liquid refrigerant stored in a liquid reservoir is moved to and stored in a stopped heat exchanger that functions as a condenser such that the excessive liquid refrigerant stored in the liquid reservoir is reduced compared to the amount before it had been moved to and stored in the heat exchanger, and it is determined whether a refrigerant is leaking from a refrigerant circuit on the basis of whether an excessive liquid refrigerant is stored or not stored in the liquid reservoir, and therefore even in a state in which the excessive liquid refrigerant is stored in the liquid reservoir, leakage of a refrigerant can be detected with a high degree of accuracy.

DETAILED DESCRIPTION

Embodiments of the present invention will be described below based on the drawings.

Figure 1:
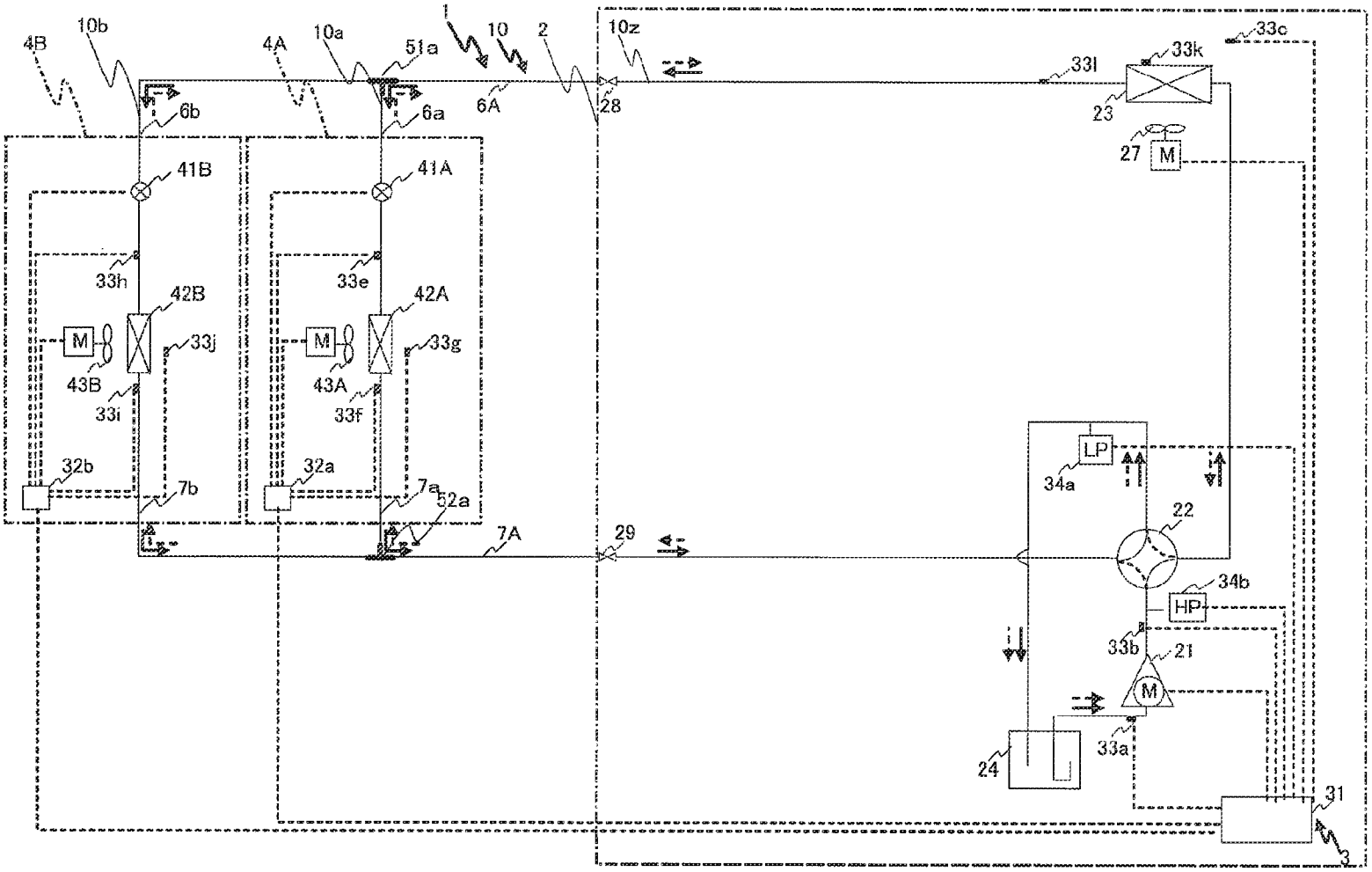
FIG. 1 is a schematic configuration diagram showing an exemplary refrigerant circuit structure of an air-conditioning apparatus according to Embodiment 1 of the present invention.

Embodiment 1:

FIG. 1 is a schematic configuration diagram showing an exemplary refrigerant circuit structure of an air-conditioning apparatus 1 according to Embodiment 1 of the present invention. On the basis of FIG. 1, the refrigerant circuit structure and operation of the air-conditioning apparatus 1 will be described. The air-conditioning apparatus 1 is installed in, for example, an office building or an apartment building, and is used for cooling or heating an area to be air-conditioned by performing a vapor compression refrigeration cycle operation. It should be noted that the dimensional relationships of components in FIG. 1 and other subsequent drawings may be different from the actual ones.

<Configuration of Air-conditioning Apparatus 1>

The air-conditioning apparatus 1 principally includes an outdoor unit 2 as a heat source device, a plurality of indoor units 4 (an indoor unit 4A, an indoor unit 4B) as plural use units (two units shown in FIG. 1) connected in parallel to the outdoor unit 2, and refrigerant extension pipes (a liquid refrigerant extension pipe, a gas refrigerant connecting pipes) which connect the outdoor unit 2 and the indoor units 4. In other words, the air-conditioning apparatus 1 includes a refrigerant circuit 10 which is formed by connecting the outdoor unit 2 and the indoor units 4 with refrigerant pipes. Incidentally, the liquid refrigerant extension pipe is constituted by a main pipe 6A, a branch pipe 6*a*, a branch pipe 6*b*, and a distributor 51*a*. Further, the gas refrigerant extension pipe is constituted by a main pipe 7A, a branch pipe 7*a*, a branch pipe 7*b*, and a distributor 52*a*.

[Indoor Units 4]

The indoor unit 4A and the indoor unit 4B are supplied with cooling energy or heating energy from the outdoor unit 2 to supply cooling air or heating air to an area to be air-conditioned. Note that in the following description, symbols "A" and "B" affixed after indoor unit 4 may be omitted. In such cases, the indoor units 4 indicate both the indoor unit 4A and the indoor unit 4B. Further, the symbol "A (or a)" is affixed to each of the reference numerals of various devices (also including a portion of the circuit) belonging to the "indoor unit 4A", and the symbol "B (or b)" is affixed to each of the reference numerals of various devices (also including a portion of the circuit) belonging to the "indoor unit 4B". In the description of these various devices as well, there are cases that symbols "A (or a)" and "B (or b)", which are affixed to the reference numerals, may be omitted, but it goes without saying that both respective devices are denoted.

The indoor units 4 are installed in a concealed or a suspended state in or from an indoor ceiling of a building or the like, or are hung on an indoor wall surface. The indoor unit 4A is connected to the outdoor unit 2 by the main pipe 6A, the distributor 51*a*, the branch pipe 6*a*, the branch pipe 7*a*, the distributor 52*a* and the main pipe 7*a*, and constitutes a portion of the refrigerant circuit 10. The indoor unit 4B is connected to the outdoor unit 2 by the main pipe 6A, the distributor 51*a*, the branch pipe 6*b*, the branch pipe 7*b*, the distributor 52*a* and the main pipe 7A, and constitutes a portion of the refrigerant circuit 10.

The indoor units 4 principally include indoor side refrigerant circuits (an indoor side refrigerant circuit 10*a*, an indoor side refrigerant circuit 10*b*), which constitute a portion of the refrigerant circuit 10. The indoor side refrigerant circuits are each principally formed in such a manner that expansion valves 41 as expansion mechanisms, and indoor heat exchangers 42 as user side heat exchangers are connected in series.

The indoor heat exchangers 42 function as condensers (radiators) of a refrigerant at the time of a heating operation, to heat indoor air, and also function as evaporators of the refrigerant at the time of a cooling operation, to cool indoor air. The indoor heat exchangers 42 exchange heat between heat medium (for example, air, water or the like) and the refrigerant, so as to condense and liquefy or evaporate and gasify the refrigerant. The type of the indoor heat exchangers 42 is not particularly limited, but for example, the indoor heat exchangers 42 may be configured as cross fin-type fin-and-tube heat exchangers or the like which are formed by heat transfer tubes and a large number of fins.

The expansion valves 41 are disposed on the liquid side of the indoor heat exchangers 42 to control the amount of refrigerant flowing in the indoor side refrigerant circuits, and are also used to reduce the pressure of the refrigerant and expand the refrigerant. The expansion valves 41 may be configured as valves whose opening degree can be controlled adjustably, for example, as electronic expansion valves or the like.

In the indoor units 4, indoor air is suctioned into the units, the heat exchangers 42 exchange heat between the air and the refrigerant, and thereafter, indoor fans 43 as air sending devices supply the air indoors as supply air. The indoor fans 43 are capable of varying the amount of air supplied into the indoor heat exchangers 42, and may be configured as, for example, centrifugal fans or multiblade fans, which are driven by a DC fan motor. However, the indoor heat exchangers 42 may also be one that exchanges heat between the refrigerant and a heat medium different from air (for example, water, brine or the like).

Further, the indoor units 4 are provided with various sensors. Provided on the liquid side of the indoor heat exchangers 42 are liquid side temperature sensors (a liquid side temperature sensor 33*f* (installed in the indoor unit 4A), and a liquid side temperature sensor 33*i* (installed in the indoor unit 4B)), which detect the temperature of the refrigerant (that is to say, a refrigerant temperature corresponding to condensation temperature Tc at the time of the heating operation or to evaporation temperature Te at the time of the cooling operation). Provided on the gas side of the indoor heat exchangers 42 are gas side temperature sensors (a gas side temperature sensor 33*e* (installed in the indoor unit 4A), and a gas side temperature sensor 33*h* (installed in the indoor unit 4B)), which detect the temperature Teo of the refrigerant.

Moreover, provided on the inlet side of the indoor air in the indoor units 4 are indoor temperature sensors detecting the temperature of the indoor air (that is, indoor temperature Tr) flowing into the indoor unit (an indoor temperature sensor 33*g* (installed in the indoor unit 4A), and an indoor temperature sensor 33*j* (installed in the indoor unit 4B)). Information detected by various sensors (temperature information) is transferred to control units (indoor side control units 32) which control operations of various devices installed in the indoor units 4, and is used for the operation control of various devices. Incidentally, the types of the liquid side temperature sensor, the gas side temperature sensor, and the indoor temperature sensor are not particularly limited, but each of the sensors may also be preferably formed by, for example, a thermistor and the like.

Further, the indoor units 4 have the indoor side control units 32 which control respective operations of various devices constituting the indoor units 4. Then, the indoor side control units 32 have microcomputers and memories provided for performing control of the indoor units 4, and can transfer and receive control signals or the like between remote-control devices (not shown) for operating the indoor units 4 individually, or can transfer and receive control signals or the like between the indoor side control units 32 and the outdoor unit 2 (specifically, an outdoor side control unit 31) via transmission lines (or radio transmission). In other words, the indoor side control units 32 function as a control unit 3 that performs the operation control of the entire air-conditioning apparatus 1 in collaboration with the outdoor side control unit 31.

[Outdoor Unit 2]

The outdoor unit 2 has the function of supplying cooling energy or heating energy to the indoor unit 4. The outdoor unit 2 is located outside of, for example, an office building or the like, and is connected to the indoor units 4 by the liquid refrigerant extension pipe and the gas refrigerant connecting pipe, thereby constituting a part of the refrigerant circuit 10. In other words, the refrigerant flow from the outdoor unit 2 into the main pipe 6A is split into the branch pipe 6*a* and the branch pipe 6*b* via the distributor 51*a*, and comes into the indoor unit 4A and indoor unit 4B, respectively. Similarly, the refrigerant flow from the outdoor unit 2 into the main pipe 7A is split into the branch pipe 7*a* and the branch pipe 7*b* via the distributor 52*a*, and flows into the indoor unit 4A and indoor unit 4B, respectively.

The outdoor unit 2 principally has an indoor side refrigerant circuit 10*z* which constitutes a part of the refrigerant circuit 10. The outdoor side refrigerant circuit 10*z* is principally formed in such a manner that a compressor 21, a four-way valve 22 as a flow switching means, an outdoor heat exchanger 23 as a heat source side heat exchanger, an accumulator 24 as a liquid reservoir, a liquid side shut-off valve 28, and a gas side shut-off valve 29 are connected in series.

The compressor 21 sucks in the refrigerant and compresses the refrigerant into a high temperature, high pressure state. The compressor 21 is capable of varying the operating capacity. For example, the compressor 21 may be formed by a positive-displacement compressor or the like, which is driven by a motor whose frequency F is controlled by an inverter. Incidentally, FIG. 1 illustrates an example in which one compressor 21 is shown, but the present invention is not limited thereto. Two or more compressors 21 may be installed connected in parallel in accordance with the number of indoor units 4 to be connected.

The four-way valve 22 is used to switch over to a direction in which the refrigerant flows at the time of the heating operation, or to a direction in which the refrigerant flows at the time of the cooling operation. At the time of the cooling operation, in order that the outdoor heat exchanger 23 may be used as a condenser of the refrigerant compressed by the compressor 21 and the indoor heat exchangers 42 may be caused to function as evaporators, the four-way valve 22 is switched so as to connect the discharge side of the compressor 21 and the gas side of the outdoor heat exchanger 23 to each other and also connect the accumulator 24 to the main pipe 7A side, as indicated by the solid line. At the time of the heating operation, in order that the indoor heat exchanger 23 may function as a condenser of the refrigerant compressed by the compressor 21 and the outdoor heat exchanger 23 may function as an evaporator, the four-way valve 22 is switched so as to connect the discharge side of the compressor 21 and the main pipe 7A to each other and also connect the accumulator 24 and the gas side of the outdoor heat exchanger 23, as indicated by the broken line.

The outdoor heat exchanger 23 functions as an evaporator of the refrigerant at the time of the heating operation, and also functions as a condenser (a radiator) of the refrigerant at the time of the cooling operation. The outdoor heat exchanger 23 performs heat exchange between heat medium (for example, air, water or the like) and the refrigerant, and evaporates and gasifies the refrigerant or condenses and liquefies the refrigerant. The type of the outdoor heat exchanger 23 is not particularly limited, but the outdoor heat exchanger may be configured as a cross fin-type fin-and-tube heat exchanger which is formed by heat transfer tubes and a large number of fins. Incidentally, the outdoor heat exchanger 23 is connected to the four-way valve 22 at the gas side thereof, and the liquid side thereof is connected to the main pipe 6A.

The outdoor unit 2 has an outdoor fan 27 as an air sending device which sucks in outdoor air into the unit, and exchange heat between the air and the refrigerant in the outdoor heat exchanger 23, and thereafter, discharges the air outdoors. The outdoor fan 27 is capable of varying the amount of air to be supplied to the outdoor heat exchanger 23, and for example, may be configures as a propeller fan or the like, which is driven by a motor including a DC fan motor. However, the outdoor heat exchanger 23 may also perform heat exchange between the refrigerant and heat medium which is different from air (for example, water, brine or the like).

The accumulator 24 is connected between the four-way valve 22 and the compressor 21, and is a reservoir in which the excessive refrigerant produced within the refrigerant circuit 10 is stored in accordance with variations of an operating load of the indoor unit 4, and the like. The liquid side shut-off valve 28 and the gas side shut-off valve 29 are provided at connection openings to external equipment and pipes (to be concrete, the main pipe 6A and the main pipe 7A), so as to permit or prevent conduction of the refrigerant.

Further, the outdoor unit 2 is provided with a plurality of pressure sensors and temperature sensors. As the pressure sensors, an inlet pressure sensor 34*a* which detects inlet pressure Ps of the compressor 21, and a discharge pressure sensor 34*b* which detects discharge pressure Pd of the compressor 21 are disposed.

As the temperature sensors, an inlet temperature sensor 33*a* provided between the accumulator 24 and the compressor 21 and detecting inlet temperature Ts of the compressor 21, a discharge temperature sensor 33*b* which detects discharge temperature Td of the compressor 21, a heat exchanger temperature sensor 33*k* which detects the temperature of the refrigerant flowing though the outdoor heat exchanger 23, a liquid side temperature sensor 331 provided on the liquid side of the outdoor heat exchanger 23, and an outdoor temperature sensor 33*c* disposed on the outdoor-air inlet side of the outdoor unit 2 and detecting the temperature of outdoor air flowing into the unit are disposed. Information (temperature information) detected by the various sensors above is transferred to the control unit (the outdoor side control unit 31) which controls respective operations of various devices installed in the indoor unit 4, and is utilized for operation control of the various devices. Incidentally, the type of each of the temperature sensors is not particularly limited, but each temperature sensor may be configured as, for example, a thermistor or the like.

Further, the outdoor unit 2 has the outdoor side control unit 31 which controls the operation of each of the components constituting the outdoor unit 2. Then, the outdoor side control unit 31 has a microcomputer provided for carrying out control of the outdoor unit 2, and an inverter circuit which controls memory and a motor, and the like. The outdoor side control unit 31 can exchange control signals and the like with the indoor side control units 32 of the indoor units 4 via transmission lines (or radio transmission). In other words, the outdoor side control unit 31 functions as the control unit 3 which performs the operation control of the entire air-conditioning apparatus 1 in collaboration with the indoor side control units 32 (refer to FIG. 2).

Figure 2:
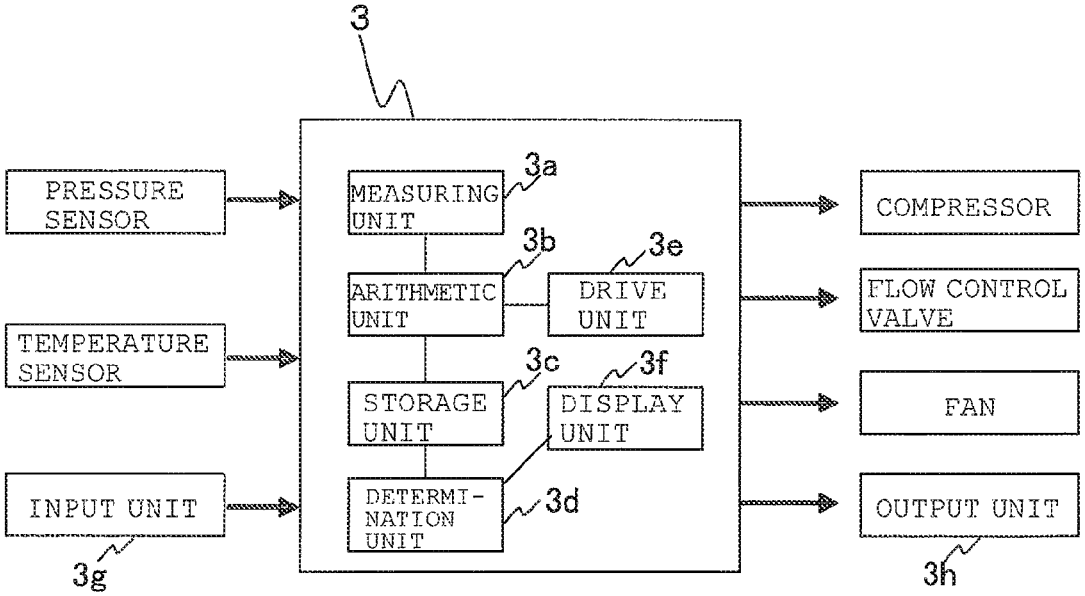
FIG. 2 is a control block diagram showing an electrical structure of the air-conditioning apparatus according to Embodiment 1 of the present invention.

Here, the control unit 3 will be described in detail. FIG. 2 is a control block diagram showing an electrical structure of the air-conditioning apparatus 1. The control unit 3 is connected to the pressure sensors (the inlet pressure sensor 34*a*, the discharge pressure sensor 34*b*), and the temperature sensors (the liquid side temperature sensor, the gas side temperature sensor, the indoor temperature sensor, the inlet temperature sensor, the discharge temperature sensor, the heat exchanger temperature sensor, the liquid side temperature sensor and the outdoor temperature sensor), so as to receive detection signals from these sensors. The control unit 3 is also connected to the sensors above so as to be capable of controlling various devices (the compressor 21, the four-way valve 22, the outdoor fan 27, the indoor fan 43, and the expansion valve 41 which functions as a flow control valve) on the basis of the detection signals above and the like.

As shown in FIG. 2, the control unit 3 is constituted from a measurement unit 3*a*, an arithmetic logic unit 3*b*, a storage unit 3*c*, a determination unit 3*d*, a drive unit 3*e*, a display unit 3*f*, an input unit 3*g* and an output unit 3*h*. The measurement unit 3*a* has the function of measuring pressure or temperature (that is, an operation state quantity) of the refrigerant which circulates in the refrigerant circuit 10 on the basis of information transferred from the pressures sensors or temperature sensors. The arithmetic logic unit 3*b* has the function of calculating the amount of refrigerant (that is, the operating state quantity) on the basis of the measurement value measured in the measurement unit 3*a*. The storage unit 3*c* has the function of storing the measurement value measured in the measurement unit 3*a*, the amount of refrigerant obtained by calculation in the arithmetic logic unit 3*b*, and information from the outside. The determination unit 3*d* has the function of determining whether leakage of a refrigerant has occurred or not by comparison between the reference amount of refrigerant stored in the storage unit 3*c* and the amount of refrigerant obtained by the calculation.

The drive unit 3*e* has the function of controlling drive of various components (specifically, a compressor motor, a valve mechanism, a fan motor and the like) which drive the air-conditioning apparatus 1. The display unit 3*f* has the function of notifying information to outside that charging of the refrigerant is completed or leakage of the refrigerant is detected, by voice or display, and notifying abnormality which has occurred in the course of operating the air-conditioning apparatus 1, by voice or display. The input unit 3*g* has the function of performing input and alteration of setting values for various controls and performing input of external information about the refrigerant charge amount and the like. The output unit 3*h* has the function of output of the measurement values measured in the measurement unit 3*a* or values calculated by the arithmetic logic unit 3*b*.

(Refrigerant Extension Pipes)

The refrigerant extension pipes (a liquid refrigerant extension pipe, a gas refrigerant connecting pipe) connect the outdoor unit 2 and the indoor units 4 to each other, so that the refrigerant circulates within the air-conditioning apparatus. In other words, the air-conditioning apparatus 1 includes the refrigerant circuit 10 which is formed by connecting various devices constituting the air-conditioning apparatus 1 by the refrigerant extension pipes, and by the circulation of the refrigerant in the refrigerant circuit 10, thereby cooling operation and a heating operation can be performed.

As described above, the refrigerant extension pipes include the main pipe 6A, the branch pipe 6*a*, the branch pipe 6*b*, the distributor 51*a*, the main pipe 7A, the branch pipe 7*a*, the branch pipe 7*b* and the distributor 52*a*. The above-described main pipe 6A, the branch pipe 6*a*, the branch pipe 6*b*, the main pipe 7A, the branch pipe 7*a* and the branch pipe 7*b* are refrigerant pipes constructed on site when the air-conditioning apparatus 1 is installed in an installation place such as a building or the like, and the respective pipe sizes of the refrigerant pipes used are determined depending on a combination of the outdoor unit 2 and the outdoor units 4.

In Embodiment 1, in order to connect one outdoor unit 2 and two indoor units 4 to each other, the refrigerant extension pipes having the distributor 51 a and the distributor 52*a* attached thereto are used. In the liquid refrigerant extension pipe, the outdoor unit 2 and the distributor 51*a* are connected to each other by the main pipe 6A, and the distributor 52*a* and each of the indoor units 4 are connected to each other by the branch pipe 6*a* and the branch pipe 6*b*, respectively. In the gas refrigerant extension pipe, each of the indoor units 4 and the distributor 52*a* are connected to each other by the branch pipe 7*a* and the branch pipe 7*b*, respectively, and the distributor 52*a* and the outdoor unit 2 are connected to each other by the main pipe 7A. Incidentally, in Embodiment 1, the refrigerant extension pipes which include the distributor 51*a* and the distributor 52*a* are described, but the distributor 51*a* and the distributor 52*a* are not necessarily essential.

The shapes of the distributor 51*a* and the distributor 52*a* may be determined in accordance with the number of the indoor units 4 to be connected. For example, as shown in FIG. 1, the distributor 51*a* and the distributor 52*a* each may be formed into a T-shaped pipe, or each may be formed by means of a header. Further, in a case in which a plurality of (three or more) indoor units 4 are to be connected, a plurality of T-shaped pipes are used to allow distribution of refrigerants, or refrigerants may be distributed by means of a header.

As described above, the indoor side refrigerant circuits (an indoor side refrigerant circuit 10*a* and an indoor side refrigerant circuit 10*b*), the outdoor side refrigerant circuit 10*z*, and the refrigerant extension pipes are connected together to constitute the air-conditioning apparatus 1. Then, the air-conditioning apparatus 1 can be performed by a switching operation of the four-way valve 22, by the control unit 3 constituted from the indoor side control unit 32 and the outdoor side control unit 31, in accordance with the cooling operation or heating operation, and controls each of the devices installed in the outdoor unit 2 and the indoor units 4 in accordance with the operating load of each of the indoor units 4.

<Operation of Air-conditioning Apparatus 1>

Figure 3:
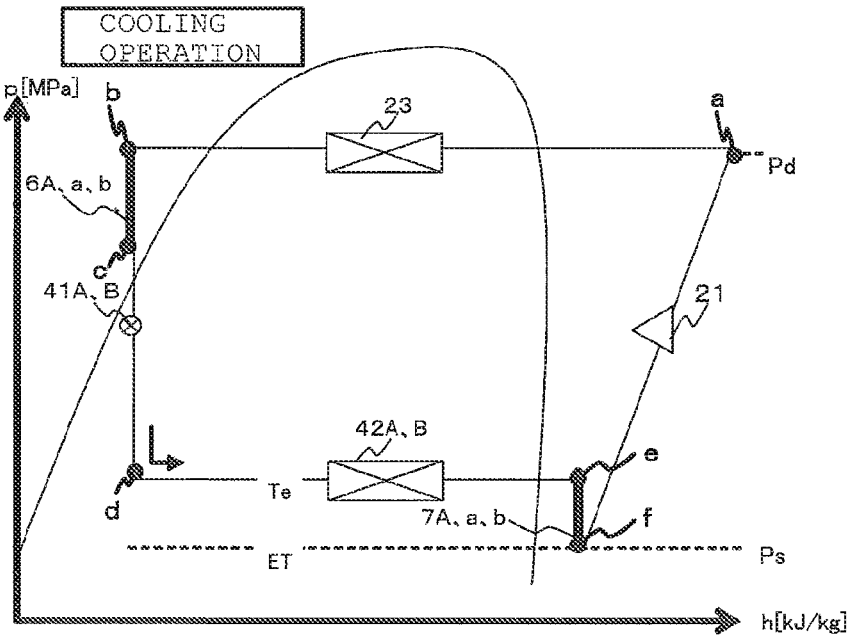
FIG. 3 is a p-h diagram at the time of a cooling operation of an air-conditioning apparatus according to an embodiment of the present invention.
Figure 4:
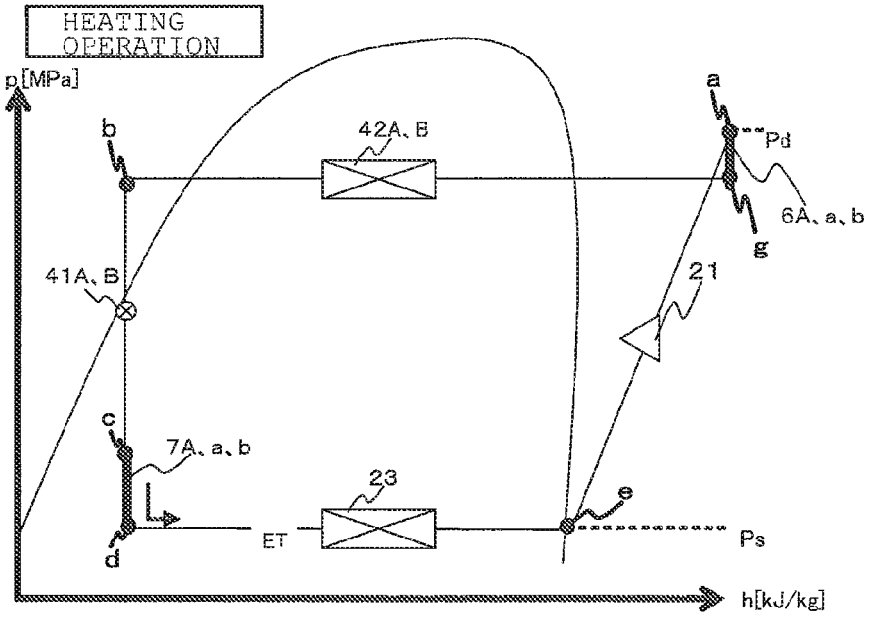
FIG. 4 is a p-h diagram at the time of a heating operation of the air-conditioning apparatus according to the embodiment of the present invention.

A description will be given below of the operation of each of the elements of the air-conditioning apparatus 1 and refrigerant leak detection. The air-conditioning apparatus 1 controls each of the devices which constitute the air-conditioning apparatus 1 in accordance with the operating load of each of the indoor units 4, and performs the cooling/heating operation. FIG. 3 is a p-h diagram at the time of the cooling operation of the air-conditioning apparatus 1. FIG. 4 is a p-h diagram at the time of the heating operation of the air-conditioning apparatus 1. Incidentally, FIG. 1 shows that the flow of a refrigerant at the time of the cooling operation is indicated by the solid arrow and the flow of a refrigerant at the time of the heating operation is indicated by the dashed arrow, respectively. Further, the air-conditioning apparatus 1 constantly performs refrigerant leak detection, and can carry out remote monitoring at a management center or the like by use of a communication line.

(Cooling Operation)

The cooling operation to be performed by the air-conditioning apparatus 1 will be described below with reference to FIGS. 1 and 3.

At the time of the cooling operation, the four-way valve 22 is in the state indicated by the solid line shown in FIG. 1, that is, the cooling operation is controlled such that the discharge side of the compressor 21 is connected to the gas side of the outdoor heat exchanger 23, and the inlet side of the compressor 21 is connected to the gas side of the indoor heat exchangers 42 via the gas side shut-off valve 29, and the main pipe 7A, the branch pipe 7*a* and the branch pipe 7*b*, which pipes constitute the gas extension pipe. Incidentally, the liquid side shut-off valve 28 and the gas side shut-off valve 29 are each brought into an open state. Further, a case in which the cooling operation is performed by all of the indoor units 4 will be described below as an example.

The low temperature, low pressure refrigerant is compressed by the compressor 21 and is discharged as the high temperature, temperature, high pressure gas refrigerant (see point a shown in FIG. 3). The high temperature, high pressure gas refrigerant discharged from the compressor 21 flows into the outdoor heat exchanger 23 via the four-way valve 22. The refrigerant flowing into the outdoor heat exchanger 23 is condensed and liquefied while rejecting heat into outdoor air by the fan action of the outdoor fan 27 (see point b shown in FIG. 3). The condensation temperature in this case is obtained by converting the pressure detected by the heat exchanger temperature sensor 33*k* or the discharge pressure sensor 34*b* into a saturation temperature.

Subsequently, the high pressure liquid refrigerant flowing from the outdoor heat exchanger 23 flows out from the outdoor unit 2 via the liquid side shut-off valve 28. The pressure of the high pressure liquid refrigerant flowing out from the outdoor unit 2 is decreased due to the pipe wall friction in the main pipe 6A, the branch pipe 6*a*, and the branch pipe 6*b* (see point c shown in FIG. 3). The refrigerant flows into the indoor units 4 and is decompressed by the expansion valves 41 to turn into a low-pressure two-phase gas-liquid refrigerant (see point d shown in FIG. 3). The two-phase gas-liquid refrigerant flows into the indoor heat exchangers 42, which function as evaporators of the refrigerant, and is evaporated and gasified by receiving heat from air since air is sent by the indoor fans 43 (see point e shown in FIG. 3). At this time, cooling is performed for an area to be air-conditioned.

The evaporation temperature in this case is measured by the temperature sensor 33*e* and the temperature sensor 33*h*. Then, the degree of superheat SH of the refrigerant at the outlets of the indoor heat exchangers 42 is obtained by subtracting the refrigerant temperature detected by the temperature sensor 33*e* and the temperature sensor 33*h* from the refrigerant temperature value detected by the temperature sensor 33*f* and the temperature sensor 33*i*. Note that the temperature sensor 33*e* and the temperature sensor 33*f*, and the temperature sensor 33*h* and the temperature sensor 33*i* are each disposed at the liquid side or at the gas side depending on whether the cooling operation or the heating operation is performed. In other words, the temperature of the refrigerant can be measured, as necessary, by the respective temperature sensors depending on the operating state.

Further, the opening degree of the expansion valves 41 is controlled such that the degree of superheat of the refrigerant at the outlets of the indoor heat exchangers 42 (at the gas side of the indoor heat exchanger 42A and the indoor heat exchanger 42B) becomes a desired value of the degree of superheat SHm.

The gas refrigerant passing through the indoor heat exchangers 42 is decompressed due to the pipe wall friction while passing through the main pipe 7A, the branch pipe 7*a*, the branch pipe 7*b* (see point f shown in FIG. 3). This refrigerant flows into the outdoor unit 2 via the gas side shut-off valve 29. The refrigerant flowing into the outdoor unit 2 is suctioned again into the compressor 21 via the four-way valve 22 and the accumulator 24. In such a manner, the air-conditioning apparatus 1 performs the cooling operation.

(Heating Operation)

The heating operation to be performed by the air-conditioning apparatus 1 will be described below with reference to FIGS. 1 and 4.

At the time of the heating operation, the four-way valve 22 is in the state indicated by the broken line in FIG. 1, that is, the heating operation is controlled such that the discharge side of the compressor 21 is connected to the gas side of the indoor heat exchangers 42 via the gas side shut-off valve 29, and the gas refrigerant extension pipes including the main pipe 7A, the branch pipe 7*a* and the branch pipe 7*b*, and the inlet side of the compressor 21 is connected to the gas side of the outdoor heat exchanger 23. Incidentally, the liquid side shut-off valve 28 and the gas side shut-off value 29 are each brought into an open state. Further, a case in which the cooling operation is performed by all the indoor units 4 will be described below as an example.

A low temperature, low pressure refrigerant is compressed by the compressor 21, and is discharged as a high temperature, high pressure gas refrigerant (see point a shown in FIG. 4). The high temperature, high pressure gas refrigerant discharged from the compressor 21 flows out from the outdoor unit 2 via the four-way valve 22 and the gas side shut-off valve 29. The high temperature, high pressure gas refrigerant flowing out from the outdoor unit 2 passes through the main pipe 7A, the branch pipe 7*a* and the branch pipe 7*b*, and the pressure thereof is decreased due to the pipe wall surface friction at this time (see point g shown in FIG. 4). This refrigerant flows into the indoor heat exchangers 42 of the indoor units 4. The refrigerant flowing into the indoor heat exchangers 42 is condensed and liquefied while rejecting heat into indoor air by the fan action of the indoor fans 43 (see point b shown in FIG. 4). At this time, heating is performed for an area to be air-conditioned.

The refrigerant flowing out from the indoor heat exchangers 42 is decompressed by the expansion valves 41 and turns into a two-phase gas-liquid refrigerant (see point c shown in FIG. 4). In this case, the opening degree of the expansion valves 41 is controlled such that the degree of supercooling SC of the refrigerant at the outlets of the indoor heat exchanger s42 is fixed at a desired value of the degree of supercooling SCm.

The degree of supercooling SC of the refrigerant at the outlets of the indoor heat exchangers 42 is obtained by conversion of the discharge pressure Pd of the compressor 21 detected by the discharge pressure sensor 34*b* into the saturation temperature value corresponding to a condensation temperature Tc and subtracting the refrigerant temperature value detected by the liquid side temperature sensor 33*e* and the liquid side temperature sensor 33*h* from the saturation temperature value of the refrigerant. Incidentally, the degree of supercooling SC may also be obtained by separately providing a temperature sensor which detects the temperature of the refrigerant flowing through each of the indoor heat exchangers 42 and subtracting the refrigerant temperature value corresponding to the condensation temperature Tc detected by the additional temperature sensor from the refrigerant temperature value detected by the liquid side temperature sensor 33*e* and the liquid side temperature sensor 33*h*.

Subsequently, a low pressure two-phase gas-liquid refrigerant passes through the main pipe 6A, the branch pipe 6*a* and the branch pipe 6*b*, is decompressed due to the pipe wall friction when passing through the main pipe 6A, branch pipe 6*a* and branch pipe 6*b* (see point d shown in FIG. 4), and thereafter, flows into the outdoor unit 2 via the liquid side shut-off valve 28. This refrigerant flowing into the outdoor unit 2 flows into the outdoor heat exchanger 23, and is evaporated and gasified by receiving heat from outside air since air is sent by the outdoor fan 27 (see point e shown in FIG. 4). Then, the refrigerant is suctioned again into the compressor 21 via the four-way valve 22 and the accumulator 24. By the flow operation above, the air-conditioning apparatus 1 performs the heating operation.

The cooling operation and the heating operation are respectively described above. The required amount of refrigerant is different for each operation, and a large amount of refrigerant is required at the time of the cooling operation in Embodiment 1. This is because the expansion valves 41 are connected to the side of the indoor units 4, and thereby the state of the refrigerant in the refrigerant extension pipes turns into a liquid phase or a gas phase at the time of the cooling operation, but at the time of the heating operation, the refrigerant has a two-phase or a gas phase. In other words, a difference between the liquid phase and the two-phase requires a large amount of refrigerant at the time of the cooling operation. Further, a large amount of refrigerant is required during the cooling operation for the reason that the average refrigerant density in the evaporator is lower with respect to that in the condenser. Usually, the internal volume of each of the indoor heat exchangers 42 is smaller than that of the outdoor heat exchanger 23. Accordingly, at the time of the cooling operation, a condenser with a large average refrigerant density becomes the outdoor heat exchanger 23, and therefore, the large amount of refrigerant is required during the cooling operation as compared to the heating operation.

Accordingly, in the air-conditioning apparatus 1, in a case in which the cooling operation and the heating operation are respectively performed by switching the four-way valve 22, the necessary amount of refrigerant is different between the cooling operation and the heating operation. In such a case, the refrigerant is charged in response to the operating state that requires a large amount of refrigerant, and in a case of the operating state that does not require much refrigerant, the excessive liquid refrigerant is stored in the accumulator 24 or the like.

(Refrigerant Leak Detection Method)

In the refrigerant circuit which can be operated by performing switching between the cooling operation and the heating operation, the operating state in which a large amount of refrigerant is required as described above (for example, the time of the cooling operation) exists. In the refrigerant circuit above, usually, the refrigerant is charged in response to the operating state in which a large amount of refrigerant is required. For this reason, in the operating state in which a large number of refrigerant is not required (for example, at the time of the heating operation), the excessive liquid refrigerant may occur. To the contrary, in the configuration having the refrigerant circuit, to which the accumulator 24 being added, like the air-conditioning apparatus 1, the excessive liquid refrigerant is stored in the accumulator 24.

Usually, in the case of the cooling operation in which no excessive liquid refrigerant is stored in the accumulator, leakage of the refrigerant can be detected by changes of the pressure and temperature of each of the elements. However, in the case of the heating operation in which the excessive liquid refrigerant is stored in the accumulator, the excessive liquid refrigerant merely decreases, and the pressure and temperature of each of the elements do not change, accordingly, leakage of the refrigerant cannot be detected from the state of the refrigeration cycle. Therefore, in the configuration having the accumulator added to the apparatus, during the operation in which a large amount of refrigerant is not required as in the heating operation, occurrence of leakage of the refrigerant is detected depending on whether the excessive liquid refrigerant is stored in the accumulator or not.

Generally, for the determination of the presence or absence of the excessive liquid refrigerant stored in the accumulator, the degree of superheat at the outlet of the accumulator is used. This is because in a case in which there is the excessive liquid refrigerant in the accumulator, the refrigerant at the outlet of the accumulator is a two-phase refrigerant or a saturated gas refrigerant, while in a case in which there is no excessive liquid refrigerant in the accumulator, the refrigerant at the outlet of the accumulator is a superheated gas refrigerant. By use of the configuration above, the presence or absence of the excessive liquid refrigerant in the accumulator is determined on the basis of the degree of superheat at the outlet of the accumulator.

Further, in a case in which no sensor is disposed at the outlet of the accumulator and the degree of superheat at the outlet of the accumulator cannot be calculated, a method in which the presence or absence of the excessive liquid refrigerant in the accumulator is determined due to the discharge temperature of the compressor may also be used. This is a detection method which utilizes a phenomenon that as the excessive liquid refrigerant in the accumulator runs out, the outlet of the accumulator is brought into the superheated gas state and the discharge temperature of the compressor also increases.

These facts show that, in a case in which there is the excessive liquid refrigerant in the accumulator, after the excessive liquid refrigerant in the accumulator runs out, leakage of the refrigerant is detected. For this reason, when the amount of excessive liquid refrigerant is large in the accumulator, detection accuracy of leakage of the refrigerant is deteriorated. In other words, in the detection method above, the amount of refrigerant leaking by the time when leakage of the refrigerant is detected inevitably becomes large.

Hence, in the air-conditioning apparatus 1, even when there is a large amount of excessive liquid refrigerant in the accumulator 24, the detection accuracy of leakage of the refrigerant is improved. The details of this mechanism will be specifically described below. In the air-conditioning apparatus 1, a part of the excessive liquid refrigerant stored in the accumulator 24 is moved and stored into the stopped indoor heat exchangers 42, whereby the amount of refrigerant stored in the accumulator 24 is made smaller so that the detection accuracy of leakage of the refrigerant is improved without affecting the operating devices.

(Liquid Refrigerant Storing Method in the Condenser)

Usually, during the heating operation, the performance of the indoor units is controlled by an open/close operation of the expansion valves. In other words, when the performance is needed, the expansion valves open. When it is not necessary so much, the expansion valves close. Then, when there the performance is not needed at all, air-conditioning is stopped. In this case, usually, in order to prevent refrigerant stagnation in the indoor units, the opening degree of the expansion valves is controlled as slightly open so that the refrigerant is not stored in stopped indoor units. To the contrary, in the air-conditioning apparatus 1, the degree of opening of the expansion valves 41 is intentionally made full, the excessive liquid refrigerant which is supposed to be stored in the accumulator 24 is positively stored in the indoor units 4.

Further, in conventional refrigerant leak detection methods, in order to reduce electric power consumption, usually, the indoor fans are stopped or are operated at a low rotation speed. To the contrary, in the air-conditioning apparatus 1, the indoor fans 43 are positively operated, so as to enhance the degree of superheat and increase the amount of liquid refrigerant in the condensers (the indoor heat exchangers 42), whereby a larger amount of refrigerant is stored in the indoor units 4.

At this moment, a case in which a large amount of refrigerant is stored in the indoor units 4 and there is no refrigerant in the accumulator 24 is also considered. Therefore, in the air-conditioning apparatus 1, the relationship between the operating state of the indoor units 4 (the number of the indoor units 4 in operation), and the presence or absence of the excessive liquid refrigerant in the accumulator 24 is initially learned in advance, and leakage of the refrigerant in the refrigerant circuit 10 is determined on the basis of the operating state of the indoor units 4 when there is the excessive liquid refrigerant in the accumulator 24, which state is obtained by the initial learning. In other words, the air-conditioning apparatus 1 performs initial learning, determines when the excessive liquid refrigerant runs out in the accumulator 24, and prevents false detection of leakage of the refrigerant. Incidentally, the initial learning will be described in detail further below.

By the method above, in the air-conditioning apparatus 1, with a larger amount of refrigerant stored in the indoor units 4 on the condensation side, a part of the excessive liquid refrigerant to be stored in the accumulator 24 is reduced, the detection accuracy of leakage of the refrigerant is enhanced, and further, the operating devices are not affected.

Figure 5:
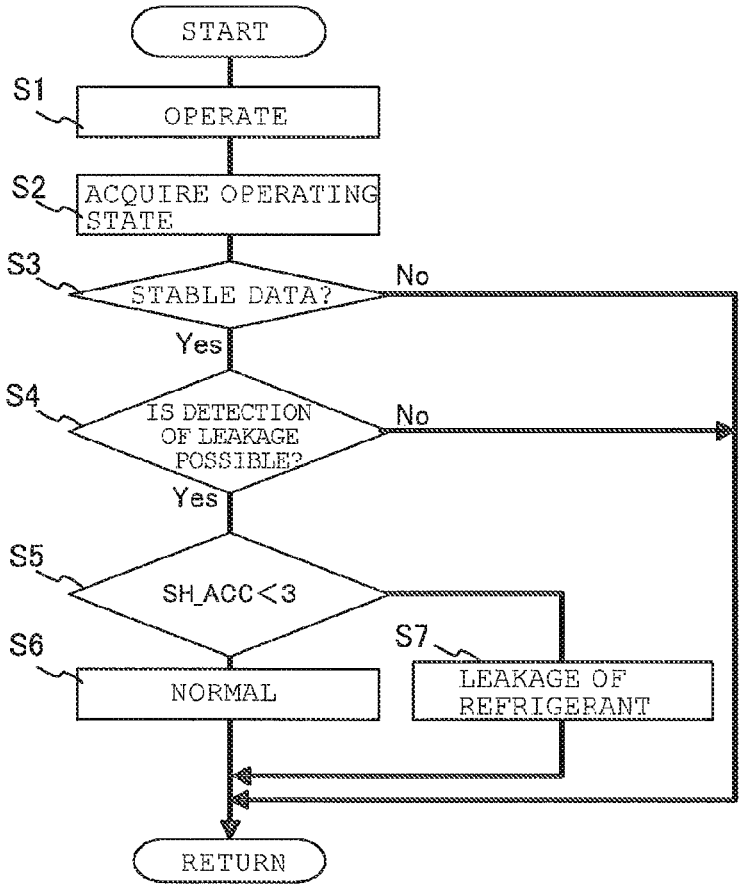
FIG. 5 is a flow chart showing an exemplary flow of refrigerant leak detection processing executed by the air-conditioning apparatus according to the embodiment of the present invention.
Figure 6:
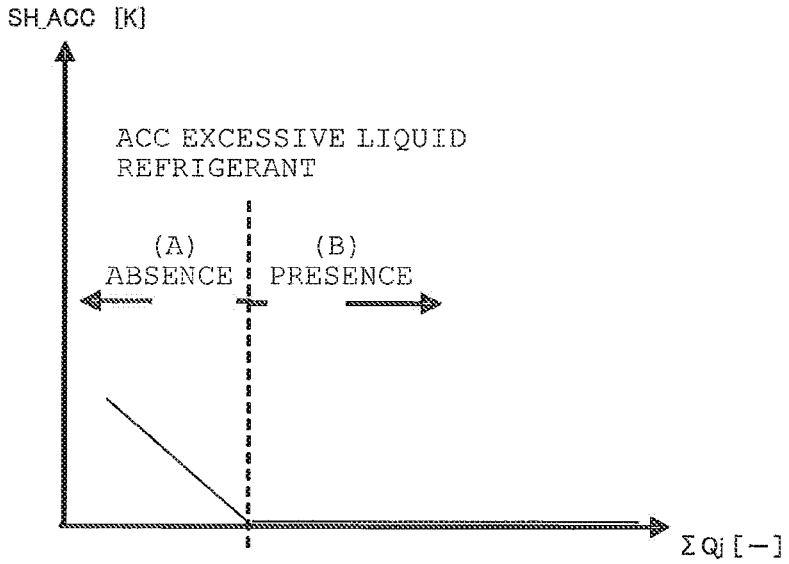
FIG. 6 is a graph which shows the relationship between a total capacity ΣQj of operating indoor unit (the horizontal axis), and a degree of superheat SH_ACC at an outlet of an accumulator (the vertical axis).
Figure 7:
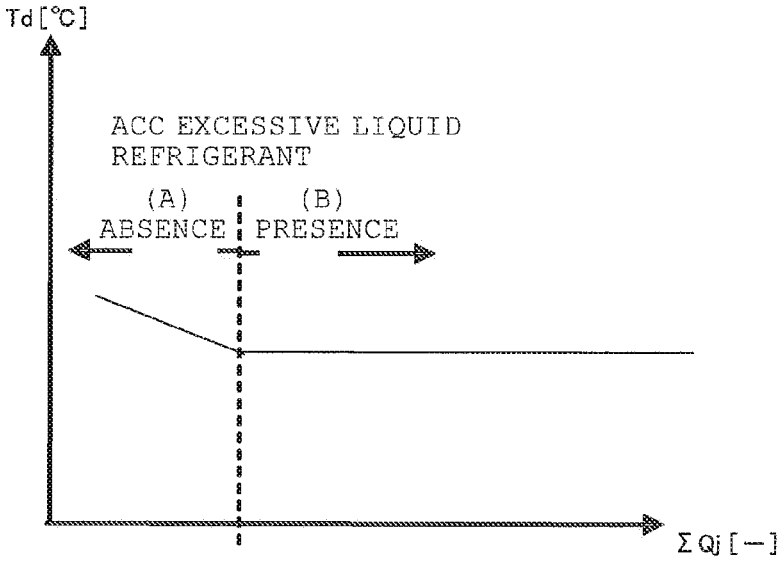
FIG. 7 is a graph which shows the relationship between a total capacity ΣQj of operating indoor unit (the horizontal axis), and a discharge temperature Td of a compressor (the vertical axis).

Here, the flow of refrigerant leak detection processing, to be executed by the air-conditioning apparatus 1, will be described in detail. FIG. 5 is a flow chart showing an exemplary flow of refrigerant leak detection processing, executed by the air-conditioning apparatus 1. FIG. 6 is a graph which shows the relationship between a total capacity $\Sigma Qj$ of operating indoor unit (the horizontal axis) and the degree of superheat SH_ACC at the outlet of the accumulator 24 (the vertical axis). FIG. 7 is a graph which shows the relationship between a total capacity $\Sigma Qj$ of operating indoor unit (the horizontal axis) and the discharge temperature Td of the compressor 21 (the vertical axis).

The control unit 3 determines whether the indoor units 4 are operating or not (S1). When the indoor units 4 are operating, the control unit 3 acquires the operating state (S2). As information of the operating state acquired at this moment, there are, for example, $\Sigma Qj$ which indicates the operating state of the indoor units 4, the compressor frequency indicating the operating state, data required for calculation of SH_ACC, and the like. That is, the control unit 3 acquires this information and determines the operating state of the indoor units 4 thereby.

Next, the control unit 3 determines whether the operating state of the indoor units 4 is stable from the acquired data (S3). If it is determined that the operating state of the indoor units 4 is stable (S3; Yes), the control unit 3 determines whether refrigerant leak detection is possible or not (S4). In this case, as shown in FIG. 6, if there is no excessive liquid refrigerant in the accumulator 24 (A), refrigerant leak detection is impossible, and the process goes to RETURN (S4; No). Incidentally, if it is determined that the operating state of the indoor units 4 is not stable, the control unit 3 does not determines whether refrigerant leak detection is possible or not, and the process goes to RETURN (S3; No).

If it is determined that the refrigerant leak detection is possible (S4; Yes), the control unit 3 determines whether expression SH_ACC<3 is satisfied or not (S5). If expression SH_ACC<3 is satisfied (S5; Yes), the control unit 3 indicates that the excessive liquid refrigerant is stored in the accumulator 24, and therefore, indicates "normal" via the display unit 3*f* (S6). If expression SH_ACC>3 is satisfied (S5; No), the control unit 3 warns of leakage of the refrigerant via the display unit 3*f* because there is no excessive liquid refrigerant in the accumulator 24 (S7).

As shown in FIG. 5, in the air-conditioning apparatus 1, SH_ACC is used as a parameter for detecting the presence or absence of the excessive liquid refrigerant in the accumulator 24. If there is the excessive liquid refrigerant in the accumulator 24, expression SH_ACC=0 is satisfied, and if the accumulator is in the gas state, the expression SH_ACC>0 is satisfied. However, disturbances such as a sensor error and the like occur in actual machines, and therefore, if expression SH_ACC<3 is satisfied in the air-conditioning apparatus 1, there is the excessive liquid refrigerant in the accumulator 24 (normal), and if expression SH_ACC>3 is satisfied, the interior of the accumulator 24 is in a gas state (in a state in which there is no excessive liquid refrigerant) (leakage of the refrigerant).

(Initial Learning)

Figure 8:
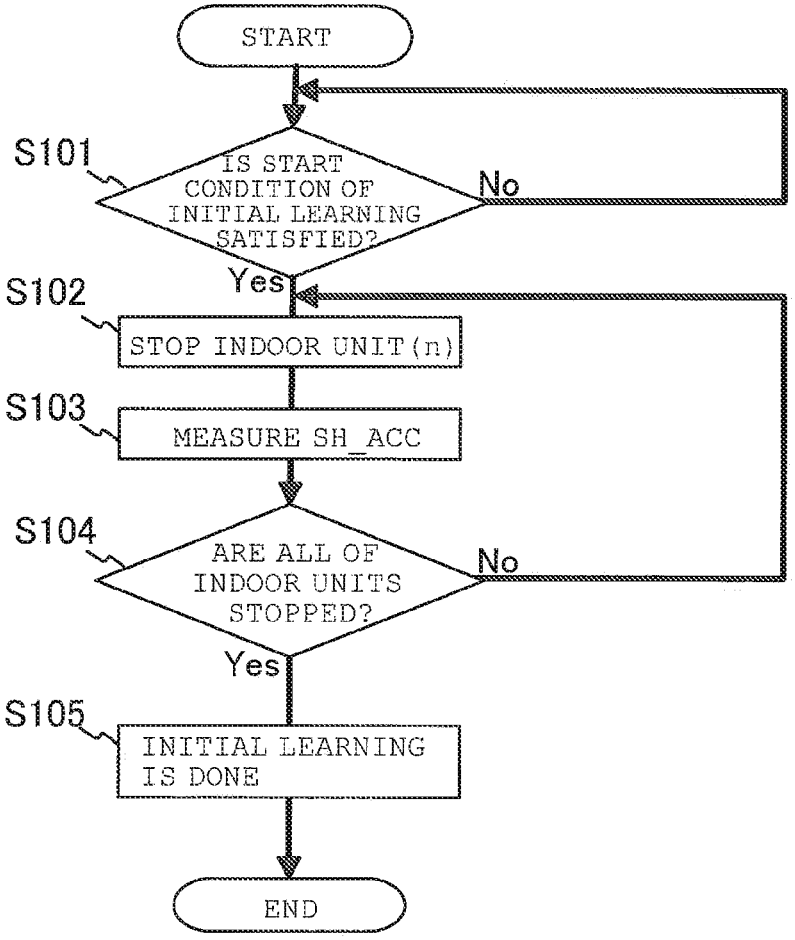
FIG. 8 is a flow chart showing an exemplary flow of processing when initial learning of the air-conditioning apparatus according to the embodiment of the present invention is performed.

Next, the initial learning to be performed by the air-conditioning apparatus 1 will be described. FIG. 8 is a flow chart showing an exemplary flow of processing in the case of performing the initial learning. In the initial learning, a determination as to whether the presence or absence of the excessive liquid refrigerant in the accumulator 24 is made, which demonstrates the operating state in which there is the excessive liquid refrigerant (that is, a boundary between the presence or absence of the excessive liquid refrigerant shown in FIGS. 6 and 7). Unless the initial learning is performed, there is a possibility that when the entire excessive liquid refrigerant is stored in the indoor unit 2 in a stopped state and there is no excessive liquid refrigerant in the accumulator 24, leakage of the refrigerant is falsely detected although no leakage of the refrigerant actually occurs.

As shown in FIG. 6, SH_ACC is a parameter that detects the presence or absence of the excessive liquid refrigerant in the accumulator 24. If there is the excessive liquid refrigerant in the accumulator 24, the expression SH_ACC=0 is satisfied, and if the accumulator is in a gas state, the expression SH_ACC>0 is satisfied. In the actual machines, disturbances such as sensor error or the like occur, and therefore, in the air-conditioning apparatus 1, if expression SH_ACC<3 is satisfied, there is the excessive liquid refrigerant in the accumulator 24, and if expression SH_ACC>3 is satisfied, the interior of the accumulator 24 is in a gas state.

Therefore, when a large amount of refrigerant is stored in the indoor units 4, the liquid refrigerant stored in the accumulator 24 runs out, and the interior of the accumulator 24 is brought into a gas state. By learning this relation, refrigerant leak detection can be performed only if there is the excessive liquid refrigerant in the accumulator 24, thereby it is possible to prevent false detection. Incidentally, a case in which SH_ACC is used as the parameter that detects the presence or absence of the excessive liquid refrigerant in the accumulator 24 is given as an example, but it is of course that the presence or absence of the excessive liquid refrigerant in the accumulator 24 can be detected even on the basis of the discharge temperature (Td) as shown in FIG. 7.

The flow of processing when the initial learning is performed will be described below with reference to FIG. 8.

First, the control unit 3 confirms whether the start condition of the initial learning is satisfied or not (S101). The specific conditions of the initial learning include, for example, a situation in which certain fixed time has elapsed since activation, a situation in which the operation of the units is stable, and the like. In other words, the control unit 3 confirms to determine whether the start condition of the initial learning is satisfied or not by at least one of the conditions above.

Next, the control unit 3 stops the operating indoor units 4 one by one (S102). Then, the control unit 3 measures the parameter SH_ACC in order to confirm whether there is the excessive liquid refrigerant in the accumulator 24 or not (S103). In this case, the indoor units 4 may preferably be stopped in ascending order of capacity. The capacity difference of the indoor units 4 can be selected based on unit type information that can be acquired by communication when connection is established. Further, it takes some time for the excessive liquid refrigerant to be moved after the indoor units 4 are stopped, and therefore, the measurement is performed after a sufficient time of period has elapsed. In this case, the time required up to start of the measurement varies depending on the length of the refrigerant extension pipes. Preferably, the waiting time may be several minutes when the pipes are short, and it may be several tens of minutes when the pipes are long.

Subsequently, the control unit 3 makes a confirmation whether all of the indoor units 4 have been stopped or not (S104). If all of the indoor units 4 have not been stopped (S104; No), the control unit 3 performs again the same operation (S102). On the other hand, if all of the indoor units 4 have been stopped (S104; Yes), the control unit 3 records completion of initial learning in the memory (the storage unit 3*c*), and completes the initial learning. In other words, the control unit 3 measures the parameter SH_ACC while stopping the indoor units 4 one by one, and learns how many indoor units 4 should be stopped until the excessive liquid refrigerant in the accumulator 24 runs out.

(Determination of Leakage of the Refrigerant)

As to a determination that leakage of refrigerant has occurred, when in a state in which the excessive liquid refrigerant is stored in the accumulator 24 (that is, in a case in which a part of the excessive liquid refrigerant is moved and the amount thereof stored is decreased), and with the decreased amount being set as a reference amount, the excessive liquid refrigerant is brought into a state of being not stored in the accumulator 24 (in a case in which the amount of refrigerant is smaller than the reference amount), it is determined that there is leakage of the refrigerant. Incidentally, the excessive liquid refrigerant remaining in the accumulator 24 may be determined depending on the capacity of the accumulator 24, the maximum amount of refrigerant which can be moved to the indoor units 4, the operating state of the air-conditioning apparatus 1, and the like.

Specifically, in the air-conditioning apparatus 1, from the viewpoint of a correlation between $\Sigma Qj$ and SH_ACC which are acquired by the initial learning, only the state in which the excessive liquid refrigerant is stored in the accumulator 24 is subject to detection, and if there is no excessive liquid refrigerant in the accumulator 24 during the operation subject to detection, it is determined that leakage of a refrigerant occurs. In other words, in the air-conditioning apparatus 1, by extracting (calculating) only the operation in which the excessive liquid refrigerant exists in the accumulator 24 during a normal operation from the correlation between a total capacity of the operating state stored by the initial learning (a total capacity of the stopped heat exchanger (the indoor heat exchangers 42 or the outdoor heat exchanger 23), which functions as the condenser), and the presence or absence of the excessive liquid refrigerant in the accumulator 24, and also confirming the excessive liquid refrigerant in the accumulator 24 at the time of the extracted operating state, leakage of the refrigerant can be detected.

Depending on the operating state, a state in which the amount of excessive liquid refrigerant in the accumulator 24 is low may also be considered, and therefore, the air-conditioning apparatus 1 can detect leakage of the refrigerant earlier compared to conventional system. Accordingly, the air-conditioning apparatus 1 can detect leakage of the refrigerant early without adding sensors for detecting the liquid level to the accumulator 24 or without altering the configuration of the refrigerant circuit 10.

Furthermore, according to the air-conditioning apparatus 1, a stopped condenser is conceived as an element which moves the excessive liquid refrigerant in the accumulator 24, and therefore, by extracting only the operating state in which there is the excessive liquid refrigerant from the relation between the capacity of the condenser which is stopping due to the initial learning, and the presence or absence of the excessive liquid refrigerant in the accumulator 24, and comparing the extracted result with the presence or absence of the excessive liquid refrigerant in the accumulator 24 in the current operating state, leakage of the refrigerant can be detected. Accordingly, the air-conditioning apparatus 1 can detect leakage of the refrigerant without affecting the system in operation.

In addition, according to the air-conditioning apparatus 1, by determination as to whether there is the excessive liquid refrigerant in the accumulator 24 or not using the degree of superheat at the outlet of the accumulator 24, leakage of the refrigerant can be detected by use of the existing sensor. Incidentally, if only the presence or absence of the excessive liquid refrigerant in the accumulator 24 can be determined by use of the discharge temperature of the compressor 21, even if there are no thermistors at the openings of the accumulator 24, the air-conditioning apparatus 1 makes it possible to detect the presence or absence of the excessive liquid refrigerant in the accumulator 24.

In the air-conditioning apparatus 1, a stopped fan is brought in operation among the fans (the indoor fans 43, the outdoor fan 27) which each supply air to the condensers, thereby a larger amount of excessive liquid refrigerant can be stored in the stopped condenser, and therefore, the amount of excessive liquid refrigerant to be stored in the accumulator 24 can be further reduced. Accordingly, in the air-conditioning apparatus 1, leakage of the refrigerant can be detected earlier. Further, according to the air-conditioning apparatus 1, the excessive liquid refrigerant is moved to the indoor units 4 in ascending order of capacity of the indoor heat exchangers 42 thereof, and thereby, decrease of the excessive liquid refrigerant can also be detected more closely in accordance with the level of leakage.

Figure 9:
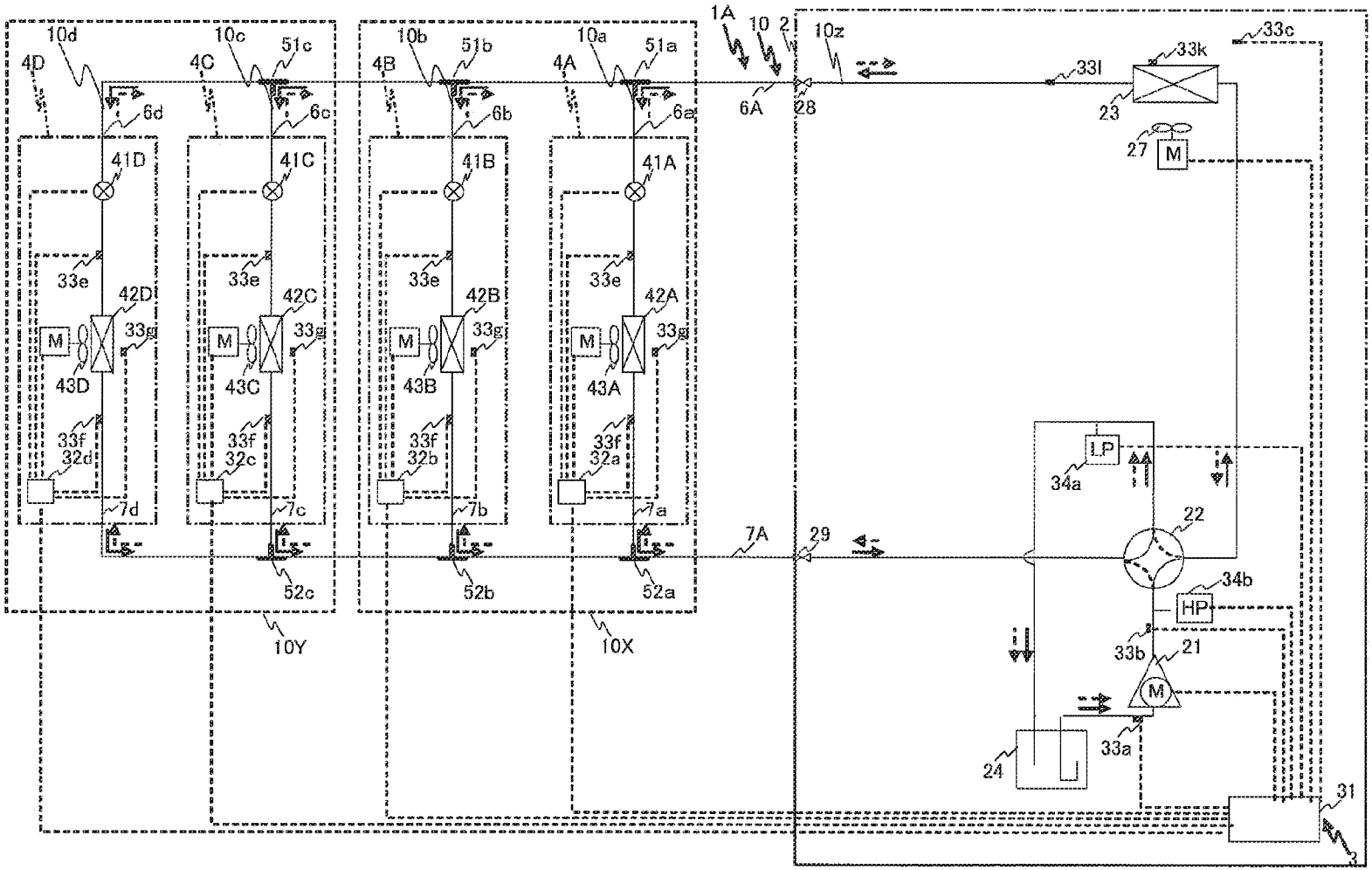
FIG. 9 is a schematic configuration diagram showing an exemplary refrigerant circuit structure of an air-conditioning apparatus according to Embodiment 2 of the present invention.
Figure 10:
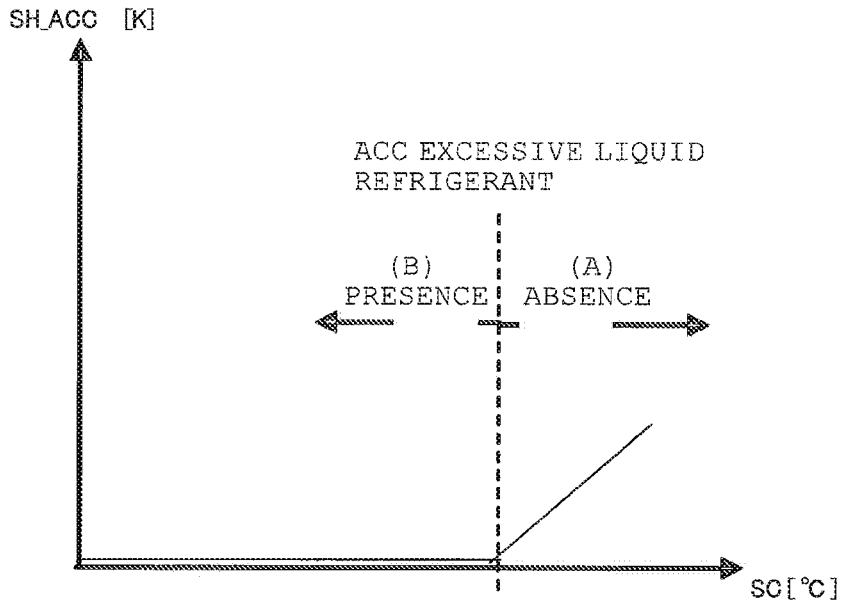
FIG. 10 is a graph which shows the relationship between the degree of supercooling SC of an indoor unit (the horizontal axis) and a degree of superheat SH_ACC at an outlet of an accumulator (the vertical axis).
Figure 11:
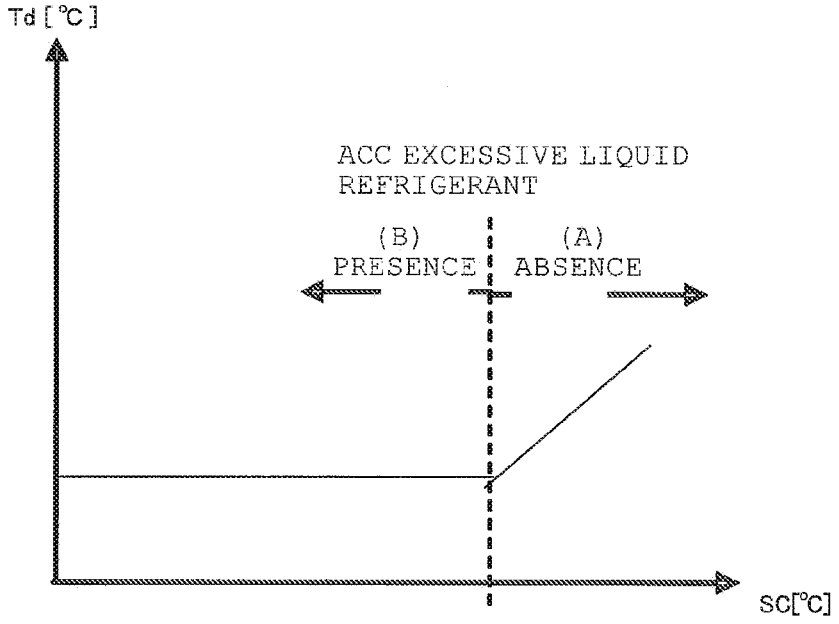
FIG. 11 is a graph which shows the relationship between the degree of supercooling SC of an indoor unit (the horizontal axis) and a discharge temperature Td of a compressor (the vertical axis).

Embodiment 2:

FIG. 9 is a schematic configuration diagram showing an exemplary refrigerant circuit structure of an air-conditioning apparatus 1A according to Embodiment 2 of the present invention. FIG. 10 is a graph which shows the relationship between the degree of superheat SC of the indoor units 4 (the horizontal axis) and the degree of superheat SH_ACC at the outlet of the accumulator 24 (the vertical axis). FIG. 11 is a graph which shows the relationship between the degree of superheat SC of the indoor unit 4 (the horizontal axis) and the discharge temperature Td of the compressor 21 (the vertical axis). On the basis of FIGS. 9 to 11, the refrigerant circuit structure of the air-conditioning apparatus 1A and the operation thereof will be described below. Note that the points of difference from Embodiment 1 will principally be described in Embodiment 2, and the same parts as those of Embodiment 1 are denoted by the same reference numerals, and descriptions thereof will be omitted.

The air-conditioning apparatus 1A is, in the same manner as in the air-conditioning apparatus 1, installed in, for example, an office building or an apartment building, and by performing a vapor compression type refrigeration cycle operation, is used to cool and heat an area to be air-conditioned. The air-conditioning apparatus 1A has a refrigerant circuit in which two indoor units are installed in each of the plurality of areas to be air-conditioned (room 10X, room 10Y). In other words, the indoor unit 4A and the indoor unit 4B are located in the room 10X, and the indoor unit 4C and the indoor unit 4D are located in the room 10Y. The configurations of the indoor unit 4C and the indoor unit 4D are the same as those of the indoor unit 4A and the indoor unit 4B as described in Embodiment 1.

In the following description, symbols "A" to "D" affixed indoor unit 4 may be omitted. In such cases, the indoor units 4 indicate the entire indoor unit 4A to indoor unit 4D. Further, the "indoor unit 4A" and the "indoor unit 4B" are the same as described in Embodiment 1, but symbol "C (or c)" is affixed to the reference numerals of each of devices (including a portion of the circuit) belonging to the "indoor unit 4C", and symbol "D (or d)" is affixed to the reference numerals of each of devices (also including a portion of the circuit) belonging to the "indoor unit 4D". In the description of these various devices as well, there are cases that the symbols "C (or c)" and "D (or d)", which are affixed to the reference numerals may be omitted, but it goes without saying that both respective devices are denoted.

The air-conditioning apparatus 1A performs a special operation by a method that affects the load side as little as possible, and detects leakage of the refrigerant. A basic method of detecting leakage of the refrigerant is the same as that of Embodiment 1. However, the air-conditioning apparatus 1A is distinguished in that, it uses the correlation between the operating indoor unit capacity $\Sigma Qj$ acquired by the initial learning and the degree of superheat at the outlet of the accumulator 24 to learn a state in which the amount of excessive liquid refrigerant in the accumulator 24 becomes the minimum (i.e., a state slightly closer to (B) with respect to the broken line as a boundary between (A) and (B) shown in FIG. 10), and reproduces the state by the special operation, whereby leakage of the refrigerant can be detected regardless of the operating state.

In the air-conditioning apparatus 1A, which is a system constituted with a plurality of indoor units disposed in each of multiple rooms, performs a special operation such that some indoor units remain operation in each of the rooms so as not to stop only the units for a special area to be air-conditioned and thereby the indoor air-conditioning is affected as little as possible. Further, in the air-conditioning apparatus 1A, out of the indoor units 4, ones with smaller capacity are preferentially selected and stopped. Specifically, when the indoor unit 4A and the indoor unit 4B are made to stop, air-conditioning of the room 10X cannot be performed, and therefore, only the indoor unit 4A and the indoor unit 4B are adapted so as not to be stopped.

Further, in the air-conditioning apparatus 1A, when the capacity of the indoor units 4 are such that 4A>4C>4B>4D, the indoor unit 4D and the indoor unit 4B which have smaller capacity are stopped so that the air-conditioning of each room is affected as little as possible. This is because, for example, stopping the indoor unit 4A and the indoor unit 4C will be stopping the ones, among the indoor units 4, having larger capacity, and therefore, if air-conditioning load is large, there is possibility that the air-conditioning performance may decrease significantly with only the operation of the indoor unit 4D and the indoor unit 4B.

Basically, the indoor units 4 are sequentially stopped by the method described in Embodiment 1. However, as an exception, if there are an indoor unit 4 with high operating ability and an indoor unit 4 with low operating ability, the unit having high ability is not stopped while the unit having low ability is stopped, irrespective of their capacities. This is because it is considered that in an indoor unit 4 having high ability, the load thereof is large, and therefore, it is chosen so as not to be stopped to the extent possible. The levels of the operating abilities of the indoor units 4 are determined by the degree of supercooling SC at the outlets of the indoor units 4, and may be discriminated in such a manner that when SC is a large value, the unit has a low ability, and if SC is a small value, the unit has a high ability.

Further, in the air-conditioning apparatus 1A, as shown in FIG. 10 or FIG. 11, the relationship between the degree of supercooling at the outlet of each of the indoor units 4, and the degree of superheat SH_ACC at the outlet of the accumulator 24, or the relationship between the degree of supercooling at the outlet of each of the indoor units 4, and the discharge temperature Td of the compressor 21 is learned by the initial learning, and thereby the presence or absence of the excessive liquid refrigerant in the accumulator 24 can be determined from the degree of supercooling SC of each room. Moreover, a timer may be set such that special operations are performed at regular time intervals. Thus refrigerant leak detection can be reliably performed and leakage of the refrigerant can be detected early.

As described above, the air-conditioning apparatus 1A exhibits the effects achieved by the air-conditioning apparatus 1 according to Embodiment 1, and also exhibits the following effects. The air-conditioning apparatus 1A can perform refrigerant leak detection without greatly affecting one or more indoor units required of its large ability by moving the excessive liquid refrigerant in the accumulator 24 to the indoor unit 4, among the indoor units 4, with a low heat exchange ability.

Furthermore, in the air-conditioning apparatus 1A, a condenser is conceived as an element which moves the excessive liquid refrigerant of the accumulator 24, and therefore, only the operating state in which there is the excessive liquid refrigerant is extracted from the relationship between the degree of supercooling of the condenser and the presence or absence of the amount of excessive liquid refrigerant in the accumulator 24, on the basis of the initial learning, and the presence or absence of the excessive liquid refrigerant in the accumulator 24 in a current operating state is compared to the former state, whereby leakage of the refrigerant can be detected. Accordingly, the air-conditioning apparatus 1 can early perform refrigerant leak detection using existing sensors.

In addition, in the air-conditioning apparatus 1A, in a case in which air-conditioning for a plurality of rooms is performed by indoor units 4, for the heating operation, the indoor units out of the indoor units 4, which moves the excessive liquid refrigerant of the accumulator 24, are not selected from units of the same room, but selected out of each room, whereby the excessive liquid refrigerant can be moved to the indoor units 4 in the state in which the air temperature of the room is maintained. Then, according to the air-conditioning apparatus 1A, a special operation mode is set at regular time intervals, and therefore, refrigerant leakage detection can be reliably performed even under any environmental conditions or installation requirements.

In Embodiment 1 and Embodiment 2 above, the system in which the refrigerant is stored in the accumulator 24 during the heating operation is described, but the present invention is not limited to it. For example, machines having a large amount of refrigerant charged at the factory, machines which require no additional refrigerant (chargeless type), and the like, that is, the machines in which the excessive liquid refrigerant is stored in the accumulator 24 even in the cooling operation are also applicable. Further, concerning the air-conditioning apparatus with a plurality of outdoor units 2, the excessive liquid refrigerant in the accumulator 24 can be decreased due to the refrigerant being stored in a stopped outdoor unit 2, and leakage of the refrigerant can also be detected early.

Moreover, in the air-conditioning apparatuses according to Embodiment 1 and Embodiment 2, it is possible to decrease transitional properties of data by means of, for example, moving average data, and it makes it possible to determine whether the amount of refrigerant is excessive or deficient, with high accuracy.

Still further, a local controller as a management device which manages various constitutional devices, and communicates with external devices such as a phone line, LAN line, radio transmission or the like, to acquire the operation data may be connected to each of the air-conditioning apparatuses according to Embodiment 1 and Embodiment 2. Then, the local controller is connected via a network to a remote server of an information management center which receives the operation data of the air-conditioning apparatus according to Embodiment 1 or Embodiment 2, and a storage device such as a disk device which stores the operation state quantity is connected to the remote server, whereby the refrigerant amount determination system may also be configured.

For example, for the air-conditioning apparatus according to Embodiment 1 and Embodiment 2, a configuration is considered in which the local controller is used as a measurement unit (measurement unit 3*a*) which acquires the operating state quantity, and also as an arithmetic logic unit (arithmetic logic unit 3*b*) which calculates the operating state quantity, and the storage device is made to function as a storage unit (storage unit 3*c*), and further, the remote server is made to function as a comparing unit or a determination unit (determination unit 3*d*).

In this case, it is not necessary that the air-conditioning apparatuses according to Embodiment 1 and Embodiment 2 have the function of obtaining and comparing a calculated refrigerant amount and a leakage ratio of the refrigerant from the current operating state quantity. Further, by configuring a system of remote monitoring in such a manner, at the time of periodic maintenance, it is not necessary for an operator to confirm whether the amount of refrigerant is excessive or deficient, in the field. Therefore, the reliability and operability of the devices are further improved.

As described above, the features of the present invention are explained for each embodiment, but the specific configuration of the invention is not limited to these embodiments and various changes may be made as long as they remain in the scope of the invention.

For example, in the embodiments above, the case in which the present invention is applied to the air-conditioning apparatus which is switchable between the cooling and heating operations is described as an example, but the present invention is not limited to it. The present invention may also be applied to an air-conditioning apparatus only either for a cooling or heating operation. Further, in these embodiments, the air-conditioning apparatus equipped with one outdoor unit 2 is shown as an example, but the present invention is not limited to it. The present invention may also be applied to an air-conditioning apparatus equipped with a plurality of outdoor units 2. Moreover, each characteristic matter of the embodiments may also be appropriately combined together for different purposes.

Note that the type of the refrigerant used in the air-conditioning apparatuses according to Embodiment 1 and Embodiment 2 is not particularly limited. For example, any of natural refrigerant such as carbon dioxide ($CO_2$), hydrocarbon, helium or the like, alternative refrigerants which contain no chlorine, such as HFC410A, HFC407C, HFC404A or the like, and fluorocarbon refrigerant such as R22 or R134a, used in existing products, may also be used. Further, in the embodiments, the case in which the present invention is applied to an air-conditioning apparatus is explained as an example, but the present invention also may be applied to other systems in which a refrigerant circuit is configured using a refrigeration cycle, such as a refrigeration system.

The invention claimed is:

1. An air-conditioning apparatus comprising:

an outdoor unit equipped with a compressor, a heat exchanger, and a liquid reservoir;

a plurality of indoor units each equipped with an expansion valve and a heat exchanger, the compressor, the heat exchanger of the outdoor unit, the liquid reservoir, the expansion valve, and the heat exchangers of each of the plurality of indoor units being connected by refrigerant extension pipes to constitute a refrigerant circuit; and a control unit, wherein the control unit in an operation state in which the heat exchanger of the each of the plurality of indoor units functions as a condenser, performs initial learning for a relationship between an operating state of the plurality of indoor units and a presence or absence of an excessive liquid refrigerant in the liquid reservoir, and then in an operation state in which a liquid refrigerant is stored in the liquid reservoir as an excessive liquid refrigerant, performs a special operation to control at least one of the plurality of indoor units in the refrigerant circuit to be in the operating state of the initial learning in which excessive liquid refrigerant is present in the liquid reservoir in the refrigerant circuit, and determines that leakage of a refrigerant from the refrigerant circuit has occurred when the excessive liquid refrigerant in the liquid reservoir is less than a reference amount, the reference amount being an amount a rest of the excessive liquid refrigerant which remains in the liquid reservoir after, by the special operation, a part of the excessive liquid refrigerant stored in the liquid reservoir is moved into and stored in the heat exchanger of at least one of the plurality of indoor units that has been stopped and that functions as a condenser.

2. The air-conditioning apparatus of claim 1, wherein the control unit determines that leakage of the refrigerant has occurred using a degree of superheat of the refrigerant at an outlet of the liquid reservoir or a discharge temperature of the refrigerant discharged from the compressor.

3. The air-conditioning apparatus of claim 1, wherein the control unit performs the initial learning by sequentially stopping the heat exchanger of each of the plurality of indoor units, measuring the degree of superheat of the refrigerant at the outlet of the liquid reservoir after a predetermined time has elapsed, and obtaining whether there is any excessive liquid refrigerant in the liquid reservoir.

4. The air-conditioning apparatus of claim 3, wherein the operating state of the each of the plurality of indoor units in the initial learning is a total capacity of the stopped heat exchanger of the at least one of the plurality of indoor units which functions as a condenser.

5. The air-conditioning apparatus of claim 3, wherein the operating state of the each of the plurality of indoor units in the initial learning is a degree of supercooling at an outlet side of the each of the plurality of indoor units.

6. The air-conditioning apparatus of claim 1, wherein the control unit operates a fan disposed in a vicinity of the stopped heat exchanger when the excessive liquid refrigerant stored in the liquid reservoir is moved to and stored in the heat exchanger of the at least one of the plurality of indoor units that has been stopped and that functions as a condenser.

7. The air-conditioning apparatus of claim 1, wherein the control unit performs the special operation in which the excessive liquid refrigerant stored in the liquid reservoir is moved to the indoor units in ascending order of capacity of the heat exchangers thereof which contribute to heat exchange.

8. The air-conditioning apparatus of claim 1, wherein the control unit performs the special operation in which the excessive liquid refrigerant stored in the liquid reservoir is moved to the indoor units in ascending order of ability of heat exchange.

9. The air-conditioning apparatus of claim 1, wherein each of the plurality of indoor units is provided in each of a plurality of areas to be air-conditioned, and the control unit performs the special operation in which the excessive liquid refrigerant stored in the liquid reservoir is moved and distributed to the plurality of indoor units disposed in different areas to be air-conditioned.

10. The air-conditioning apparatus of claim 7, further comprising a timer, wherein the control unit performs the special operation with the timer at regular time intervals.

11. The air-conditioning apparatus of claim 1, wherein the liquid reservoir is an accumulator.

12. The air-conditioning apparatus of claim 8, further comprising a timer, wherein the control unit performs the special operation with the timer at regular time intervals.

13. The air-conditioning apparatus of claim 9, further comprising a timer, wherein the control unit performs the special operation with the timer at regular time intervals.

14. The air-conditioning apparatus of claim 1, wherein on the basis of the operating state of the each of the plurality of indoor units when the excessive liquid refrigerant is determined to be absent in the liquid reservoir as obtained by the initial learning, refrigerant leak detection on the basis of excessive liquid refrigerant in the liquid reservoir is omitted to prevent false detection.

* * * * *